US011846102B2

(12) United States Patent
Kohls et al.

(10) Patent No.: US 11,846,102 B2
(45) Date of Patent: Dec. 19, 2023

(54) SHEATHING CLAMPS FOR UNBONDED POST-TENSIONING ASSEMBLIES

(71) Applicant: Polyform, Inc., Salem, OR (US)

(72) Inventors: Patrick Kohls, Las Vegas, NV (US); Jonathan Kohls, Salem, OR (US)

(73) Assignee: Polyform, Inc., Salem, OR (US)

( * ) Notice: Subject to any disclaimer, the term of this patent is extended or adjusted under 35 U.S.C. 154(b) by 0 days.

(21) Appl. No.: 17/553,347

(22) Filed: Dec. 16, 2021

(65) Prior Publication Data

US 2022/0195731 A1 Jun. 23, 2022

Related U.S. Application Data

(60) Provisional application No. 63/126,998, filed on Dec. 17, 2020.

(51) Int. Cl.

| | |
|---|---|
| ***E04C 5/10*** | (2006.01) |
| ***E04C 5/12*** | (2006.01) |
| ***E04G 21/12*** | (2006.01) |

(52) U.S. Cl.

CPC ..... *E04C 5/10* (2013.01); *E04C 5/122* (2013.01); *E04G 21/12* (2013.01)

(58) Field of Classification Search

CPC ..... E04C 5/10; E04C 5/122; E04G 21/12

See application file for complete search history.

(56) References Cited

U.S. PATENT DOCUMENTS

| | | | | |
|---|---|---|---|---|
| 3,795,949 | A * | 3/1974 | Shorter | E04C 5/122 52/223.13 |
| 3,801,067 | A * | 4/1974 | Shorter | E04C 5/122 254/29 A |
| 4,065,221 | A * | 12/1977 | Cawthorne | F16G 11/04 403/284 |
| 4,095,328 | A * | 6/1978 | Cawthorne | B23P 11/00 29/515 |
| 5,079,879 | A * | 1/1992 | Rodriguez | E04C 5/12 52/223.13 |
| 5,347,777 | A * | 9/1994 | Sudduth | E04C 5/122 52/223.13 |
| 5,788,398 | A * | 8/1998 | Sorkin | E04C 5/12 52/223.13 |
| 5,939,003 | A * | 8/1999 | Crigler | E04C 5/12 52/223.13 |
| 6,381,912 | B1 * | 5/2002 | Sorkin | E04C 5/122 52/223.13 |
| 7,055,288 | B2 * | 6/2006 | Coogan | E04C 5/10 52/748.11 |

(Continued)

*Primary Examiner* — Rodney Mintz

(74) *Attorney, Agent, or Firm* — Klarquist Sparkman, LLP

(57) ABSTRACT

This disclosure is directed to retention clamps that may be included in post-tensioning assemblies. More specifically, in some embodiments, a sheathing-retaining clamp for a post-tensioning assembly may comprise a body adjustable between an open position and a closed position, wherein in the closed position, the body is configured to wrap around a tendon assembly of the post-tensioning assembly, and a fastening mechanism configured to lock the body in the closed position. In some such embodiments, the sheathing-retaining clamp may additionally comprise a plurality of compression ribs that extend radially inwards from the body in the closed position and that are configured to directly contact a sleeve of the tendon assembly.

30 Claims, 7 Drawing Sheets

(56) References Cited

U.S. PATENT DOCUMENTS

| | | | | |
|---|---|---|---|---|
| 7,793,473 | B2 * | 9/2010 | Sorkin | E04C 5/12 403/374.1 |
| 7,797,894 | B1 * | 9/2010 | Sorkin | E04C 5/122 403/374.1 |
| 8,839,594 | B2 * | 9/2014 | Smith | H02G 3/083 52/220.8 |
| 8,931,152 | B2 * | 1/2015 | Parente | E04G 21/12 29/253 |
| 10,378,210 | B2 * | 8/2019 | Hayes | E04C 5/12 |
| 10,472,826 | B2 * | 11/2019 | Ki | F16B 7/18 |
| 11,255,096 | B2 * | 2/2022 | Taylor | E04G 21/12 |
| 2004/0206026 | A1 * | 10/2004 | Coogan | E04C 5/10 52/222 |
| 2006/0201083 | A1 * | 9/2006 | Hayes | E04C 5/165 52/223.13 |
| 2009/0077913 | A1 * | 3/2009 | Sorkin | E04C 5/10 52/223.13 |
| 2012/0266441 | A1 * | 10/2012 | Parente | E04G 21/12 29/270 |
| 2013/0004232 | A1 * | 1/2013 | Smith | H02G 3/088 403/23 |
| 2017/0138050 | A1 * | 5/2017 | Ki | F16B 7/18 |
| 2018/0023298 | A1 * | 1/2018 | Hayes | E04C 5/10 52/223.13 |
| 2020/0378123 | A1 * | 12/2020 | Sorkin | E04C 5/125 |
| 2021/0156161 | A1 * | 5/2021 | Taylor | E04C 5/122 |
| 2021/0340782 | A1 * | 11/2021 | Taylor | E04G 21/125 |

* cited by examiner

SHEATHING CLAMPS FOR UNBONDED POST-TENSIONING ASSEMBLIES

CROSS-REFERENCE TO RELATED APPLICATION

This application claims priority to U.S. Provisional Patent Application No. 63/126,998, filed on Dec. 17, 2020. The provisional application is incorporated by reference herein.

FIELD

This disclosure relates generally to concrete post-tensioning assemblies, and more particularly to retention clamps for a sheathing of said post-tensioning assemblies.

BACKGROUND

Post-tensioning assemblies may be used to reinforce and strengthen concrete. They typically include tendons (e.g., metal cables) that are strung between anchors positioned at opposite ends of the concrete slab. The tendons are encased in a protecting covering (e.g., a duct, sheathing, and/or sleeve) that prevents the concrete from bonding directly with the tendons, thereby allowing the tendons to move relative to the concrete (and thus be tensioned) after the concrete has been poured. The post-tensioning assemblies are assembled with the concrete forms before the concrete is poured and the concrete is thereafter poured into the forms over the covered tendons. Once the concrete has been poured, the free end (often referred to as the "live end") of each tendon is pulled tight (tensioned) by, for example, a hydraulic jack, and is then secured in this tensioned state with a locking mechanism (e.g., wedge). Specifically, the locking mechanism may couple the free end of the tendon to one of the anchors. The other end of the tendon (often referred to as the "dead end" because it is the end that is not pulled by the hydraulic jack) may similarly be coupled to the other anchor positioned at the opposite end of the concrete slab. In this way, the stretched/tensioned tendons are strung between the diametrically opposed anchors and provide a compressive to the concrete via the anchors (i.e., the anchors transfer the compressive forces of the stretched/tensioned tendons to the concrete), thereby strengthening the concrete.

Post-tensioning assemblies are typically categorized as either unbonded or bonded. In bonded post-tensioning assemblies, the tendons are permanently bonded to the surrounding duct (e.g., via grouting) after they have been tensioned and thus cannot be re-tensioned. The tendons of unbonded post-tensioning assemblies on the other hand, are encased in an extruded plastic sheathing that is filled with a lubricative grease, allowing the tendons to be repeatedly re-tensioned as desired.

Although the tendons in these unbonded post-tensioning assemblies must be able to slide relative to the sheathing during tensioning, movement of the sheathing relative to the tendons prior to pouring of the concrete is not desired because such relative movement may expose portions of the tendons to the concrete, allowing the concrete to bond directly to the tendons. Such bonding can inhibit and/or entirely prevent the tendons from being tensioned. Further, when not protected by the sheathing, the tendons may be more susceptible to corrosion. Movement of the sheathing relative to the tendons may occur prior to pouring of the concrete if the sheathing shrinks relative to the tendons, which can occur for various reasons, such as due to changes in temperature. When this shrinkage of the sheathing occurs, the sheathing may recede away from the ends of the tendons, thereby exposing the end portions of the tendons. As explained above, these exposed end portions of the tendons may make the tensioning process more difficult or impossible and/or may be more susceptible to corrosion. Thus, some attempts have been made to secure the sheathing in place so that it does shrink, move, and/or otherwise expose the tendons prior to pouring of the concrete. However, such attempts are overly complicated and expensive. Thus, streamlined, more cost-effective ways of preventing sheathing shrinkage prior to concrete pouring are desired.

SUMMARY

Aspects and advantages of the disclosed technology will be set forth in part in the following description, or may be obvious from the description, or may be learned through practice of the technology disclosed in the description.

Disclosed herein are retention clamps for post-tensioning anchors that can minimize and/or prevent sheathing shrinkage and/or movement relative to tendons in a post-tensioning assembly. The clamps are simpler, cheaper, and easier to use than existing means for holding the sheathing in place relative to the tendons of a post-tensioning assembly.

In some embodiments, a sheathing-retaining clamp for a post-tensioning assembly comprises a body and fastening mechanism. The body may be adjustable between an open position and a closed position, wherein in the closed position, the body is configured to wrap around a tendon assembly of the post-tensioning assembly. The fastening mechanism may be configured to lock the body in the closed position. In some such embodiments, the sheathing-retaining clamp also may comprise a plurality of compression ribs that extend radially inwards from an inner side of the body. The compression ribs may be configured to directly contact and/or squeeze the tendon assembly when the body is in the closed position.

In other embodiments, a concrete post-tensioning assembly comprises: an anchor, a tendon assembly comprising a tendon and a sheathing covering the tendon; and a sheathing clamp that is configured to prevent movement of the sheathing relative to the tendon. The sheathing-retaining clamp may comprise a body and fastening mechanism. The body may be adjustable between an open position and a closed position, wherein in the closed position, the body is configured to wrap around the tendon assembly of the post-tensioning assembly. The fastening mechanism may be configured to lock the body in the closed position. In some such embodiments, the sheathing-retaining clamp also may comprise a plurality of compression ribs that extend radially inwards from an inner surface of the body. The compression ribs may be configured to directly contact and/or squeeze the tendon assembly when the body is in the closed position.

These and other features, aspects, and/or advantages of the present disclosure will become better understood with reference to the following description and the claims. The accompanying drawings, which are incorporated in and constitute a part of this specification, illustrate embodiments of the disclosed technology and, together with the description, explain the principles of the disclosure.

DETAILED DESCRIPTION

General Considerations

Figure 1:
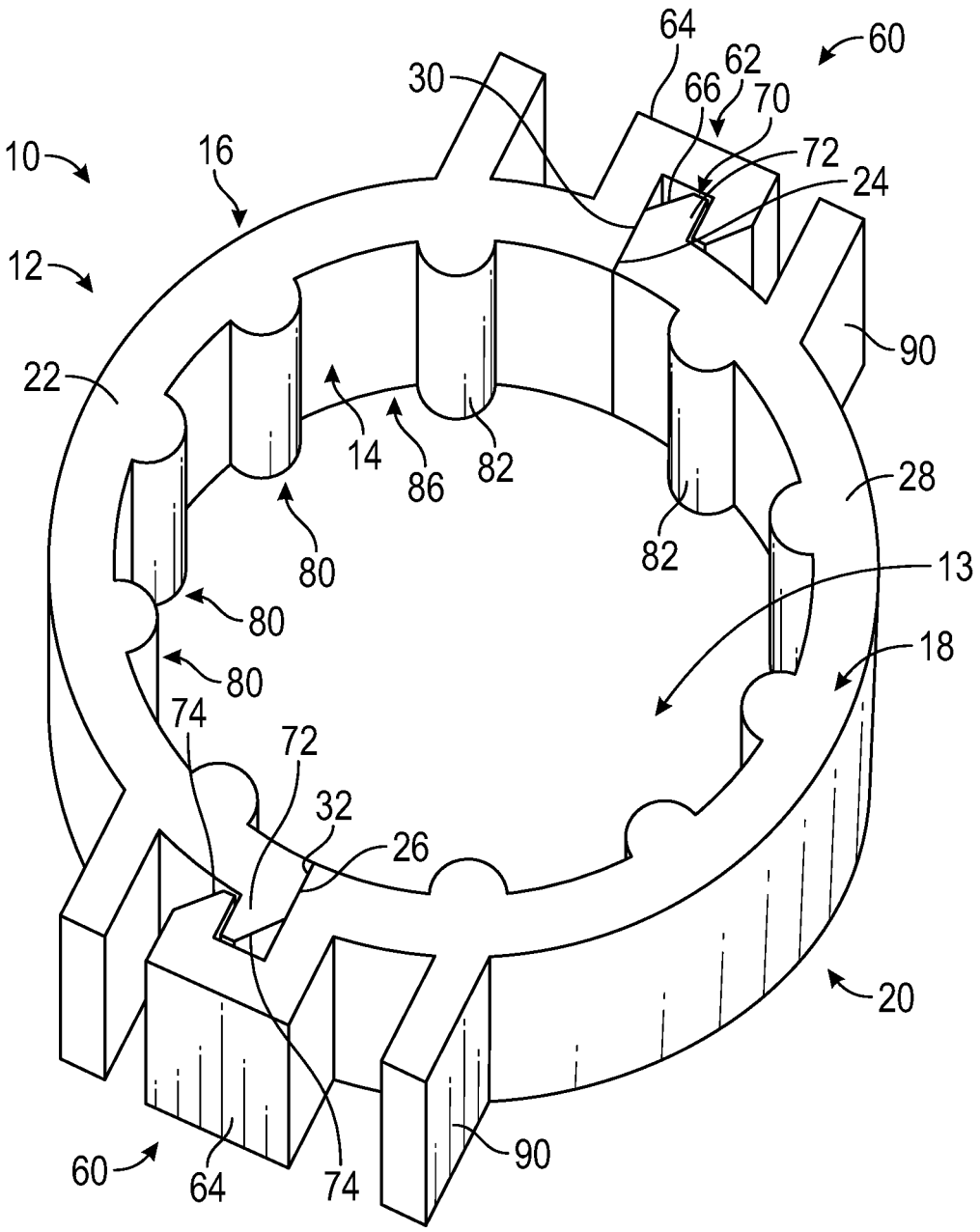
FIG. 1 is an elevated perspective view of a sheathing clamp, according to one embodiment.

The apparatuses and devices described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application, the singular forms "a," "an," and "the" include the plural forms unless the context clearly dictates otherwise. Additionally, the term "includes" means "comprises." Further, the terms "coupled" or "secured" encompass mechanical and chemical couplings, as well as other practical ways of coupling or linking items together, and do not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the terms "fixedly attached" and "fixedly coupled" refer to two components joined in a manner such that the components may not be readily separated from one another without destroying and/or damaging one or both of the components. Exemplary modalities of fixed attachment may include joining with permanent adhesive, stitches, welding or other thermal bonding, and/or other joining techniques. In addition, two components may be "fixedly attached" or "fixedly coupled" by virtue of being integrally formed, for example, in a molding process.

In contrast, the terms "removably attached" or "removably coupled" refer to two components joined in a manner such that the components can be readily separated from one another to return to their separate, discrete forms without destroying and/or damaging either component. Exemplary modalities of temporary attachment may include mating-type connections, releasable fasteners, removable stitches, and/or other temporary joining techniques.

As used herein, the term "tendon" refers to metal cables or other structures that are used (e.g., tensioned) in concrete post-tensioning assemblies to provide additional support to the concrete. As used herein, the term "anchor" refers to the metal plates and/or other components of anchorage assemblies that are positioned at opposite ends of a concrete slab to transfer the compressive force of the tensioned tendons to the concrete. As used herein, the term "sheathing" refers to a plastic covering for the tendon that is configured to seal and/or protect the tendon from concrete and corrosion.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and 0not intended to be limiting. Other features of the disclosure are apparent from the detailed description, abstract, and drawings.

The Disclosed Technology and Exemplary Embodiments

Disclosed herein are sheathing clamps for an unbonded post-tensioning assembly. The sheathing clamps may restrict and/or prevent movement between the sheathing and the tendons (e.g., shrinkage of the sheathing over the tendons) of the post-tensioning assembly prior to the concrete being poured over the post-tensioning assembly. By keeping the sheathing clamped to the tendons prior to the pouring of the concrete, the sheathing clamps of the present disclosure may ensure that no portions of the tendons are directly exposed to the concrete when the concrete is poured in the forms. Additionally, because the sheathing clamps can be constructed from a single, unitary piece, or two or more similar or identical pieces, they may be easier and cheaper to manufacture than conventional clamping devices. Further, the sheathing clamps may be easier to use because they can be attached to the sheathing at any time using a simple clamping procedure.

Figure 2:
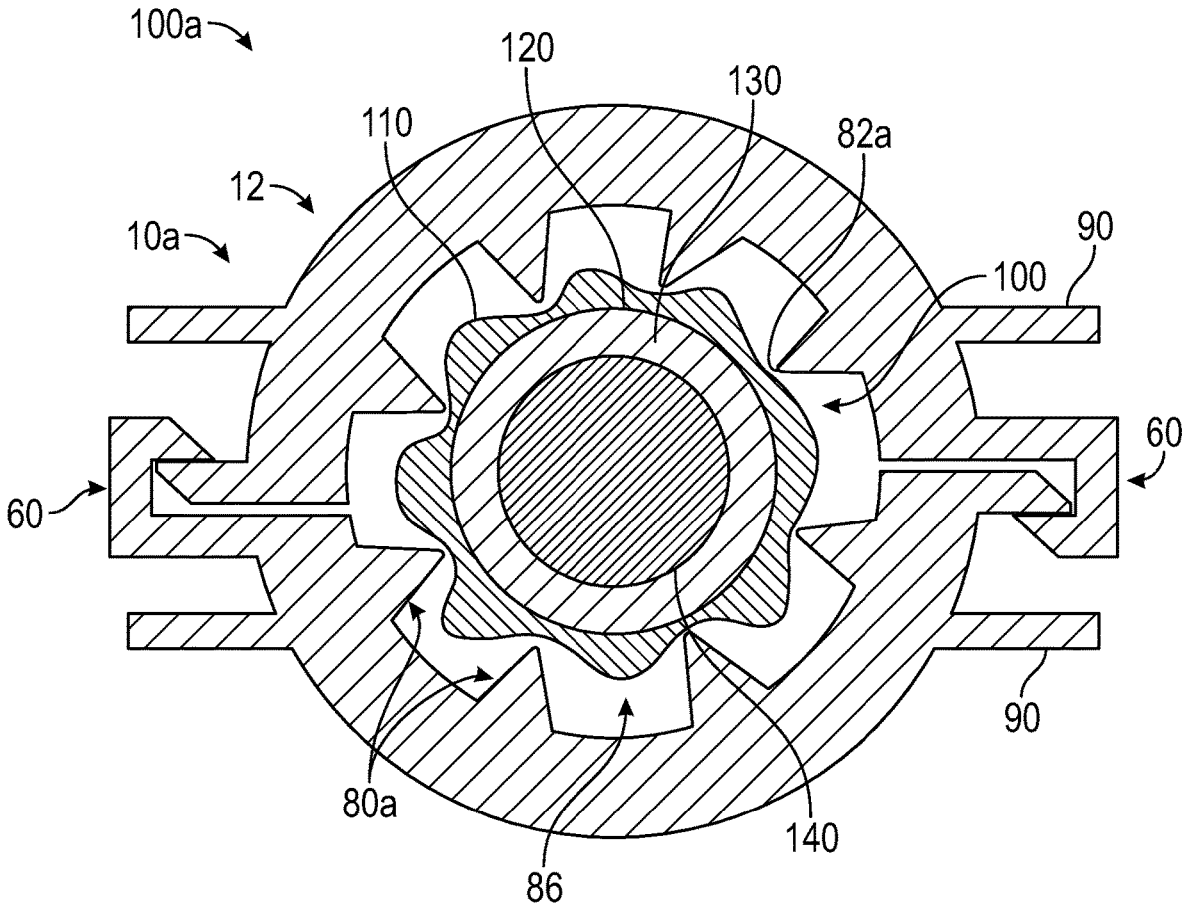
FIG. 2 is a cross-sectional view of another embodiment of a sheathing clamp, included in an exemplary tendon assembly.
Figure 3:
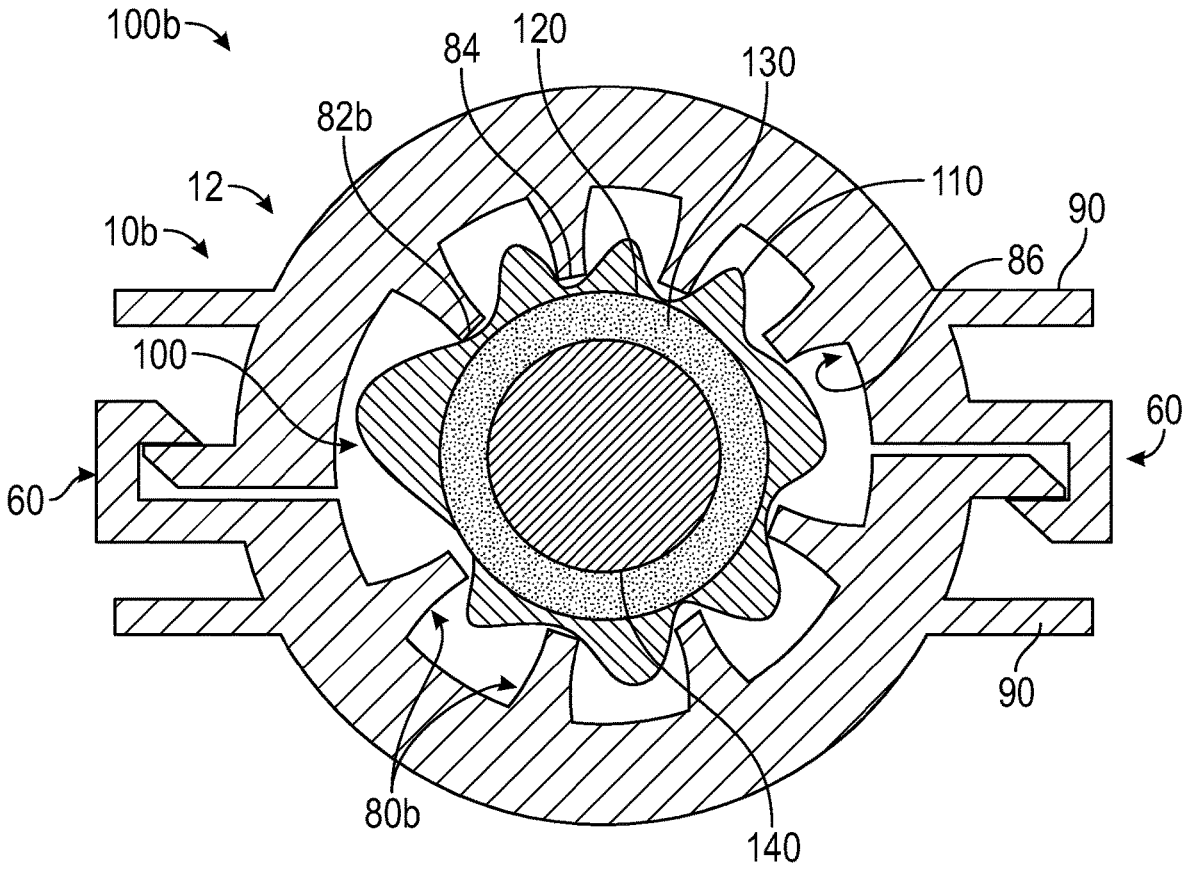
FIG. 3 is a cross-sectional view of another embodiment of a sheathing, included in an exemplary tendon assembly.
Figure 4:
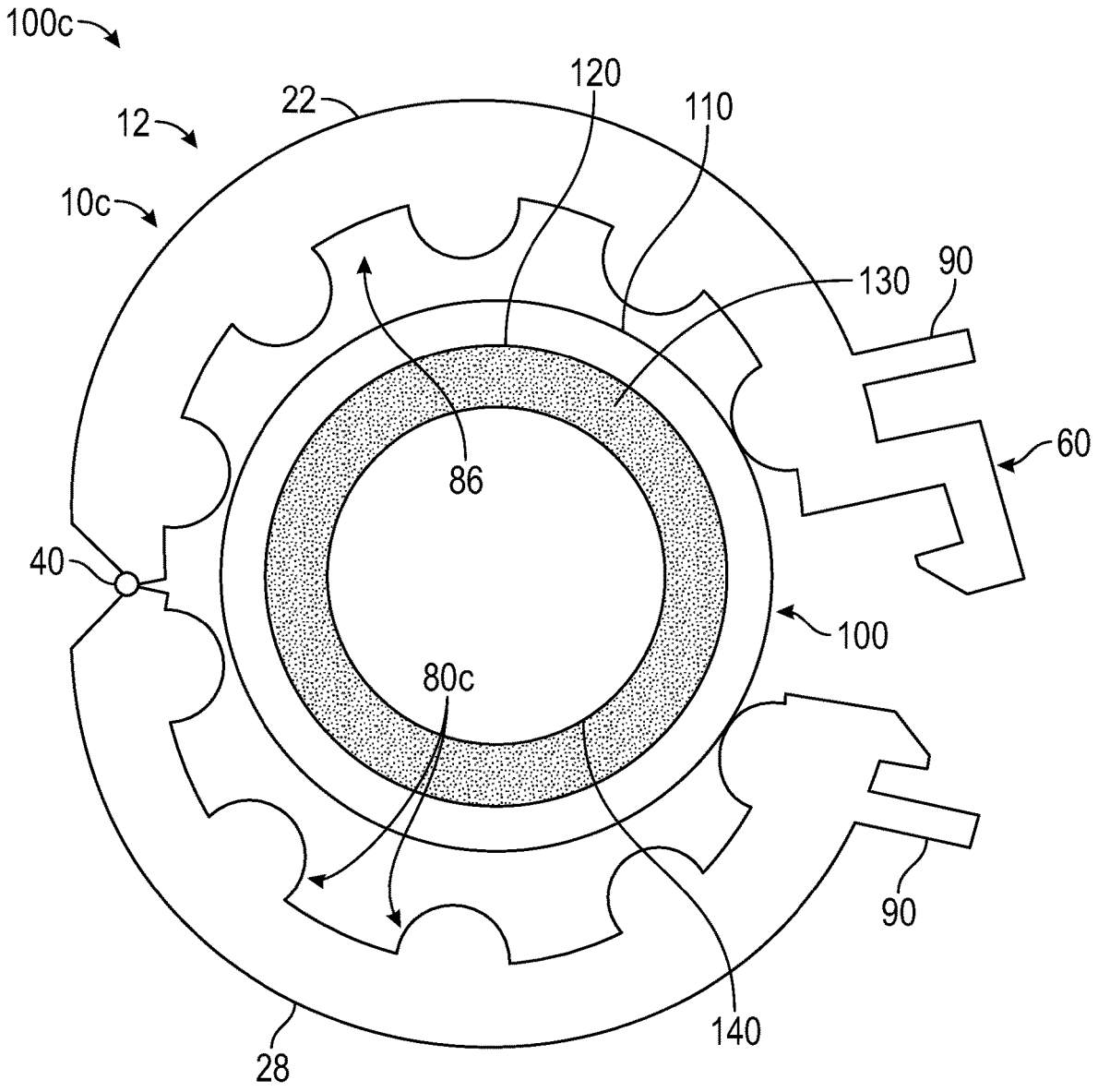
FIG. 4 is a cross-sectional view of another embodiment of a sheathing, included in an exemplary tendon assembly.
Figure 5:
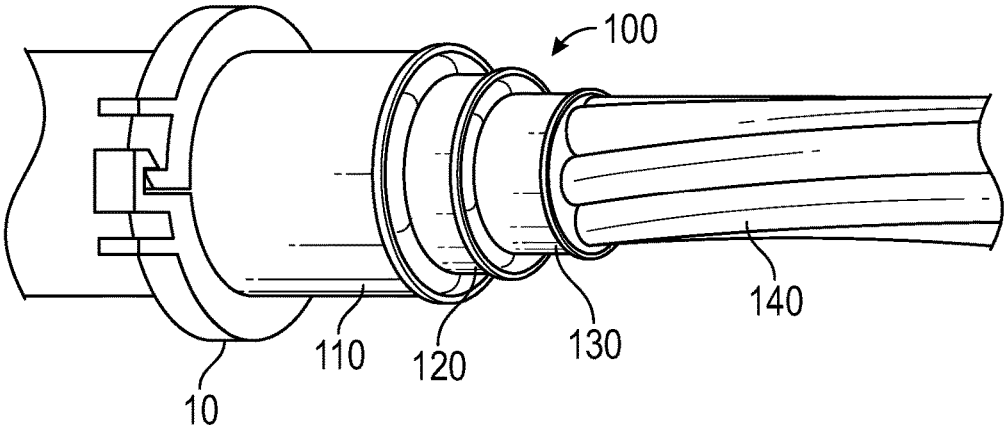
FIG. 5 is a side perspective cut-away view of a tendon assembly of a post-tensioning assembly, according to one embodiment.
Figure 6:
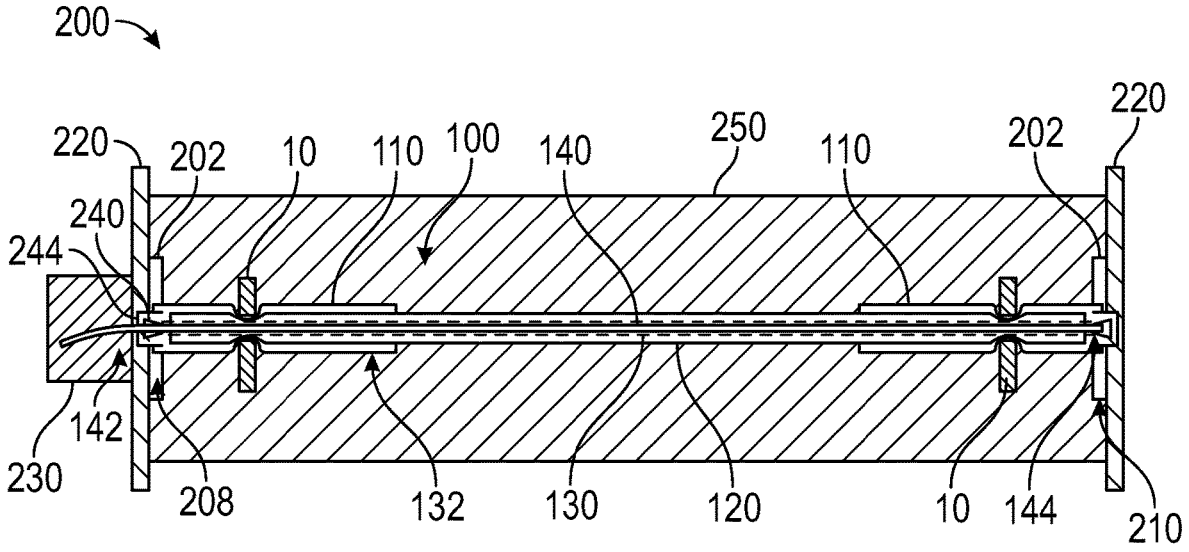
FIG. 6 is a schematic of a post-tensioning assembly, according to one embodiment.
Figure 7:
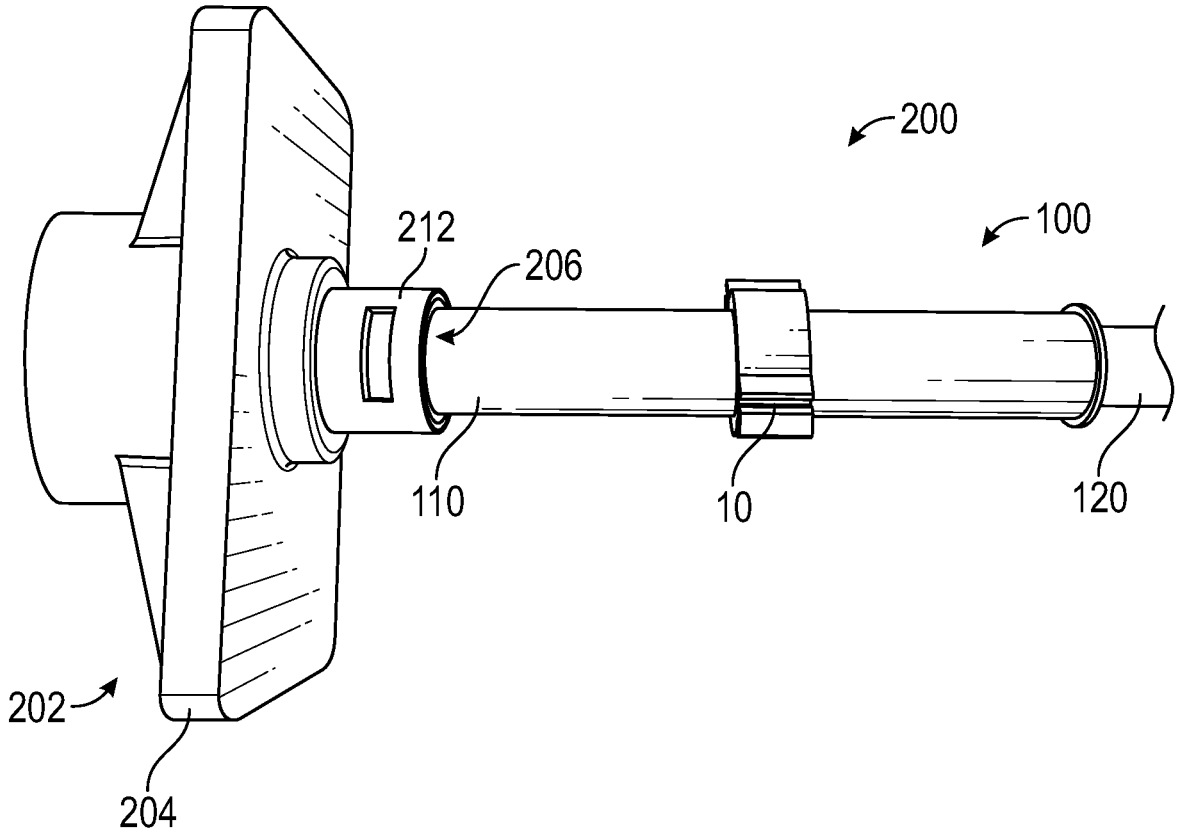
FIG. 7 is a perspective view of an end portion of a post-tensioning assembly, according to one embodiment.
Figure 8:
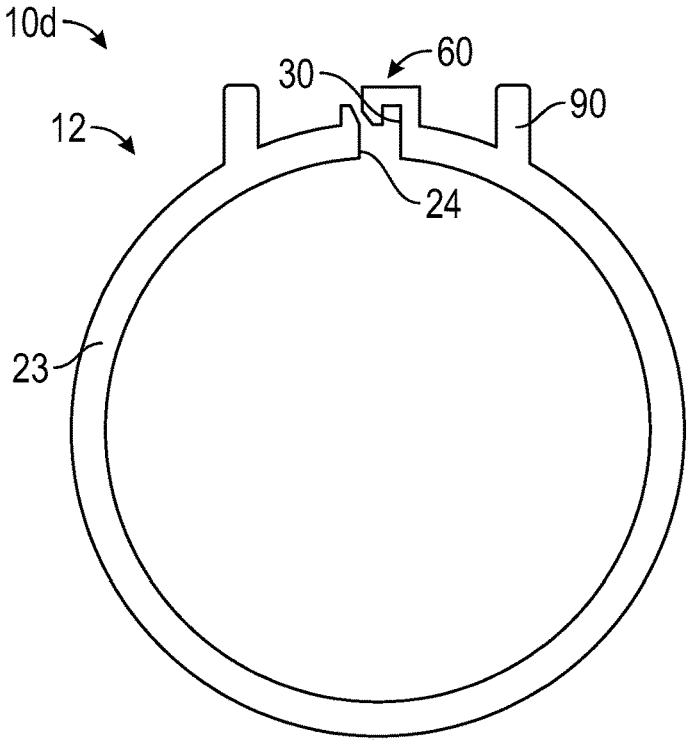
FIG. 8 is an end view of another embodiment of the sheathing clamp.
Figure 9:
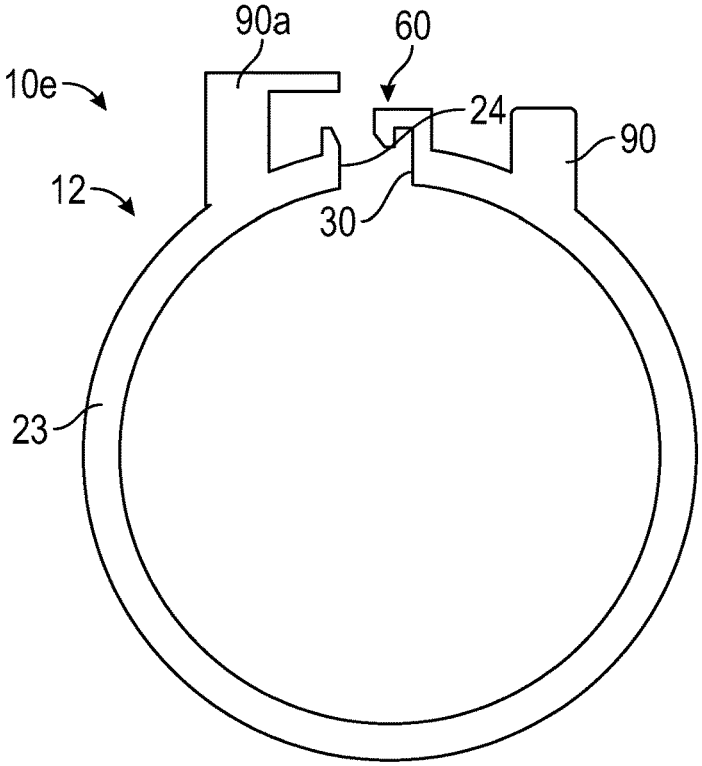
FIG. 9 is an end view of another embodiment of the sheathing clamp.

FIGS. 1-4 and 8-9 depict various embodiments of sheathing clamps. Specifically, FIG. 1 shows a top perspective view of an exemplary sheathing clamp, while FIGS. 2-4 and 8-9 show various other views of the sheathing clamp taken along cutting plane A-A. Specifically, FIGS. 2-3 show alternate embodiments (e.g., shapes) for the sleeve-engaging projections of the sheathing clamp, while FIG. 4 shows an embodiment where the sheathing clamp is hinged instead of comprising two separate, detachable pieces like in FIGS. 1-3. FIGS. 8-9 depict an embodiment of the sheathing clamp where the sheathing clamp comprises a single piece that is flexible enough to be stretched around a tendon assembly, with FIG. 9 showing an alternative embodiment of closure tabs for the sheathing clamp. FIG. 5 depicts the exemplary sheathing clamp of FIGS. 1-4 clamping an exemplary tendon assembly. Finally, FIGS. 6 and 7 depict exemplary post-tensioning assemblies that includes the exemplary sheathing clamp of FIGS. 1-4. Specifically, FIG. 7 shows an end portion (e.g., live end portion) of an exemplary post-tensioning assembly.

As shown in FIGS. 1 and 8-9, a sheathing clamp 10 (which also may be referred to as "sheathing-retaining clamp 10," "clamp 10," and/or "retention clamp 10") comprises a body 12 that is adjustable between a closed position (FIGS. 1-3) and an open position (FIGS. 4 and 8-9), and a fastening mechanism 60 that is configured to selectively lock the body 12 in the closed position. The body 12 comprises a first side 14 (which also may be referred to as an "inner concave side 14" and a "concave first side 14") opposite a second side 16 (which also may be referred to as an "outer side 14"), and a third side 18 opposite a fourth side 20. In the description herein, the "thickness" of the body 12 refers to the distance between the first side 14 and the second side 16, while the "width" of the body 12 refers to the distance between the third side 18 and the fourth side 20.

In the closed position, the body 12 comprises, has, and/or otherwise defines a lumen 13 (which also may be referred to herein as "channel 13") that is configured to receive a tendon assembly 100*a-f* (e.g., FIGS. 2-7) of a post-tensioning assembly 200 (FIGS. 6-7). Thus, the body 12 may be configured to wrap around the tendon assembly 100*a-f*, such that in the closed position, the tendon assembly 100 *a-f* is received within the lumen 13. Thus, the body 12 and/or the lumen 13 may be sized and/or shaped to accommodate the tendon assembly 100. In some examples, the body 12 is configured to wrap around a sleeve 110 (FIGS. 2-7) of the tendon assembly 100*a-f* in the closed position, such that the body 12 directly touches, compresses, engages, and/or otherwise interfaces with the sleeve 110. In some examples, the first side 14 of the body 12 may shaped and/or sized to match the geometry and/or shape of the sleeve 110. For example, as depicted in FIGS. 1-4 and 8-9, disregarding compression ribs 80 and 80*a-c* (FIGS. 1-4), the first side 14 may be generally circular and/or concave when viewed from a plane parallel to cutting plane A-A, and may be particularly well suited for receiving a cylindrical sleeve having a circular cross-section, such as is depicted in FIGS. 2-5. However, in other examples, it should be appreciated that the first side 14 can have other shapes such as rectangular, triangular, circular, elliptical, etc., when viewed from a plane parallel to cutting plane A-A. In some examples, the shape of the first side 14 may depend on the shape of the sleeve 110 (e.g., the shape of the first side 14 may be set to match the shape of the sleeve 110). Additionally, or alternatively, the shape of the compression ribs 80 may be adjusted to accommodate different shapes and/or geometries of the sleeve 110. In other examples, the shape of the first side 14 may be independent of the shape of the sleeve 110.

Similarly, although the second side 16 is depicted as circular when viewed from a plane parallel to the cutting plane A-A, it should be appreciated that the second side 16 may comprise other shapes and/or geometries in other examples. Further, the shape of the second side 16 may be independent of the shape of the sleeve 110, as the second side 16 does not face the sleeve 110. That said, in examples, where the first and second sides 14 and 16, respectively, are substantially circular (as shown in FIGS. 1-4), the body 12 is substantially annul ar. In some such examples, the outside diameter of the body 12 (diameter of the first side 14) may be at least 0.75 inches and at most 1.5 inches and the inside diameter of the body may be at least 0.5 inches and at most 1.25 inch. In some examples, the body may not be tapered, such that the cross-sectional area of cross-sections of the lumen taken along planes parallel to cutting plane A-A are substantially the same/uniform along the width of the body 12. However, in other examples, the body may be tapered, such that it does not have a uniform cross-sectional area across its width (e.g., the body 12 may be narrower or wider at the third side 18 than the fourth side 20; narrower or wider at the middle than at the sides 18 and 20, etc.).

In the example shown in FIG. 1, the third side 18 and the fourth side 20 may be substantially flat and/or planar. However, in other examples, the third side 18 and/or the fourth side 20 may be rounded, curved, and/or comprise other geometries.

In some examples, such as the examples shown in FIGS. 1-4, the body 12 may comprise two distinct pieces. Specifically, the body 12 may comprise a first piece 22 having a first end 24 opposite a second end 26 and a second piece 28 having a first end 30 opposite a second end 32. In the closed position, the first ends 24 and 30 of the first and second pieces 22 and 28, respectively, may abut one another and/or be positioned adjacent to one another, and the second ends 26 and 32 of the first piece 22 and the second piece 28, respectively, may abut one another and/or be positioned adjacent to one another to form, define, and/or otherwise enclose the lumen 13.

In some examples, the two pieces 22 and 28 may be completely selectively detached from one another, such as by releasing two fastening mechanisms 60 included at opposite ends of the two pieces 22 and 28. Specifically, the clamp 10 may include one fastening mechanism 60 at the first ends 24 and 30 of the first and second pieces 22 and 28, respectively, and another fastening mechanism 60 at the second ends 26 and 32 of the first and second pieces 22 and 28, respectively.

In other examples (FIG. 4), the two pieces 22 and 28 may be permanently coupled to one another at one of their ends but may still be configured to move (e.g., pivot) relative to one another, such as via a hinge 40, to transition between the open and closed positions. However, even in examples where the clamp 10 includes the hinge 40, the clamp 10 may still include at least one fastening mechanism 60 at the ends of the two pieces 22 and 28 opposite the hinge 40 to selectively lock the two pieces 22 and 28 in the closed position. As just one example, the clamp 10 may include the hinge 40 at the first ends 24 and 30 of the first and second pieces 22 and 28, respectively, and the fastening mechanism 60 at the second ends 26 and 32 of the first and second pieces 22 and 28, respectively. In another example, the clamp 10 may include the hinge 40 at the second ends 26 and 32 of the first and second pieces 22 and 28, respectively, and may include the fastening mechanism 60 at the first ends 24 and 30 of the first and second pieces 22 and 28, respectively.

In yet further examples (FIGS. 8-9), the body 12 may comprise a single, unitary (i.e., integrally formed) piece 23 that is only openable at the first ends 24 and 30. In such examples, the body 12 may be flexible enough to move between the open and closed positions by stretching, bending, and otherwise contorting the body 12.

The fastening mechanism 60 is adjustable between an engaged state and a disengaged state to selectively lock the body 12 in the closed position. Specifically, the fastening mechanism 60 may be engaged to couple the first ends 24 and 30 together and/or to couple the second ends 26 and 32 together, and may be disengaged to unlock the body 12 from the closed position so that the body 12 can be opened (i.e., moved towards the open position). The fastening mechanism 60 may comprise a female component 62 and a male component 70 each of which is included on adjacent ends of the body 12 to be coupled (e.g., the female component 62 may be included on one of the first ends 24 or 30, and the male component 70 may be included on the other one of the first ends 24 or 30 that does not have the female component 62). The female and male components 62 and 70, respectively, are configured to selectively mate and/or engage with one another to couple the adjacent ends of the body 12 and lock the body 12 in the closed position.

In the examples depicted in FIGS. 1-3 (where the clamp 10 comprises two detachable pieces), each of the pieces 22 and 28 includes both a female component 62 and a male component 70 at opposite ends, with the orientation of the male and female components being reversed so that, in the closed position, the male component of one piece is adjacent to the female component of the other piece, and vice versa. Specifically, in the examples depicted in FIGS. 1-3, the female component 62 is included at the first end 24 of the first piece 22 and the second end 32 of the second piece 28, while the male component 70 is included at the first end 30 of the second piece 28 and the second end 26 of the first piece 22. However, in other examples, one of the two pieces 22 and 28 may include two male components 70 and the other one of the two pieces 22 and 28 may include two female components 62. In some examples (FIGS. 1-4 and 8-9), the female and male components 62 and 70 may extend outward (e.g., radially outward) from the second side 16 of the body 12, away from the lumen 13.

In some examples, the fastening mechanism 60 may comprise a mechanical fastening mechanism. For example, as depicted in FIGS. 1-4 and 8-9, the female component 62 may comprise a hook 64 having and/or defining a groove 66, and the male component 70 may comprise a tooth 72 that is configured to be received by the groove 66 of the female component 62 to couple the adjacent ends of the body 12 together. Specially the tooth 72 may extend into the groove 66 in the closed position such that the tooth 72 and groove 66 overlap. These overlapping portions of the tooth 72 and groove 66 may hold the ends of the body 12 together and lock the body 12 in the closed position. In other examples, the fastening mechanism 60 may comprise other suitable types of mechanical fastening mechanisms, such as hook and loop fasteners, mating and interfacing teeth, interlocking loops, latches, other types of snap-fit fasteners, threaded fasteners, etc. Further, although only mechanical fastening mechanisms are depicted in FIGS. 1-4, it should be appreciated that other suitable types of fastening mechanisms, such as magnetic fastening mechanisms, may be employed in other examples.

In some examples, the female component 62 and/or the male component 70 may include ramped surfaces 74 that facilitate the closure of the body 12 (i.e., the ramped surface may help the body 12 snap into place in the closed position as the body 12 nears the closed position). Specifically, when the body 12 is almost in the closed position (FIG. 8), the male and female components 70 and 62 may come into contact with one another. As they do, the ramped surfaces may help the male and female components 70 and 62 slide past one another more easily so that less force is required to completely close the body 12. For example, the ramped surface 74 may help the tooth 72 and the hook 64 slide past one another when they come into contact with one another as the body 12 is moving towards (and is almost in) the closed position to allow the body 12 to be moved to the closed position with less force.

In some examples, the state of the fastening mechanism 60 (engaged or disengaged) is dependent on the position of the body 12. For example, in the embodiments depicted in FIGS. 1-4 and 8-9 the fastening mechanism 60 is engaged whenever the body 12 is moved to the closed position (i.e., moving the body 12 to the closed position necessarily engages the fastening mechanism 60). This is because the fastening mechanism 60 shown in the embodiments of FIGS. 1-4 and 8-9 is a snap-fit type fastening mechanism 60 that engages by virtue of the body 12 being moved to the closed position. However, in other examples, the fastening mechanism 60 may be selectively engaged (to lock the body 12 in its current position) and disengaged independent of the position of the body 12. Thus, in such examples, the body 12 can be moved to the closed position and the fastening mechanism 60 can then be engaged when desired to lock the body 12 in the closed position. As just one example of such an independently engageable locking mechanism, the fastening mechanism 60 may comprise a latch.

Further, in the examples shown in FIGS. 1-4 and 8-9, the fastening mechanism 60 is not adjustable in that it only locks the body 12 at a fixed lumen size (e.g., fixed inner diameter) and/or with a fixed clamping force, when engaged. However, in other examples, the fastening mechanism 60 may comprise an adjustable fastening mechanism 60 that is configured to lock the body 12 at different lumen sizes and/or provide varying clamping forces. As just one such example, the fastening mechanism 60 may comprise a ratchet or other type of stepped tooth arrangement that can be incrementally tightened to increase the clamping force of the clamp 10 and/or constrict the size of the lumen 13.

It should be appreciated that while the body 12 may be openable (i.e., the fastening mechanism 60 may be releasable) when not clamping the tendon assembly 100*a-f*, once the two pieces 22 and 28 are locked in the closed position on the tendon assembly 100*a-f* (FIGS. 2-7), the body 12 may be harder to open due to the forces exerted on the fastening mechanism 60 by the tendon assembly 100 *a-f* that resist compression and tend to hold the fastening mechanism 60 in the engaged state. That said, in some such examples, the body 12 may still be openable even after being clamped on the tendon assembly 100*a-f*. This may be desirable, for example, to reposition the clamp 10 on the tendon assembly 100 *a-f* and/or to remove the clamp 10 just before pouring the concrete so that the clamp 10 can be reused on another tendon assembly.

In some examples, the clamp 10 may remain on the tendon assembly 100*a-f* during and after the concrete pouring process to ensure that sheathing 120 (FIGS. 2-7) does not move relative to tendon 140 (FIGS. 2-6). In some such examples, the body 12 may become permanently locked in the closed position (e.g., the two pieces 22 and 28 may become permanently coupled to one another) after the concrete has been poured. In such examples, the clamp 10 may squeeze the sheathing 120 against the tendon 140 with enough compressive force to keep the sheathing 120 fixed relative to the tendon 140 prior to tendon tensioning (e.g., to prevent shrinkage of the sheathing 120 over the tendon 140). However, the clamp 10 may not squeeze the sheathing 120 with so much force that the tendon 140 can no longer move relative to the sheathing 120 during tensioning. Thus, the clamp may hold the sheathing 120 tightly enough against the tendon 140 to prevent relative movement between the sheathing 120 and the tendon 140 prior to tendon tensioning, but may hold the sheathing 120 loosely enough against the tendon 140 to still allow the tendon to slide relative to the sheathing 120 during tensioning.

The clamp 10 may further include closure tabs 90 on either side of each fastening mechanism 60 that are configured to act as surfaces that a tool or human hand can squeeze to close the body 12 (i.e., move the body 12 to the closed position) and/or to engage the fastening mechanism 60 to lock the body 12 in the closed position. Thus, the closure tabs 90 are configured to interface with a tool or human hand to facilitate closure of the body 12 and/or locking of the body 12 in the closed position. The closure tabs 90 may extend outwardly from the second side 16 of the body 12. In some examples, such as is depicted in FIGS. 1-4 and 8-9, the closure tabs 90 may extends outwardly from the second side 16 of the body 12 in substantially the same direction as the fastening mechanism 60 (e.g., parallel to the fastening mechanism) and may be spaced away from the fastening mechanism 60 such that the closure tabs 90 do not directly abut or touch the fastening mechanisms 60. Thus, the closure tabs 90 may be separated from the fastening mechanisms 60 by a gap. This may allow the closure tabs 90 to bend slightly under compressive loads without damaging and/or sacrificing the integrity of the fastening mechanism 60. In some examples (FIG. 9), the closure tabs 90 may be angled, bent, and/or curved such that they extend over one or both of the female component 62 and/or the male component 70 of the fastening mechanism 60.

In some examples (FIGS. 8-9), the first side 14 of the body 12 is substantially smooth and/or uniform. For example, the first side 14 of the body 12 may be circular when viewed from a plane parallel to cutting plane A-A. However, in other examples, the first side 14 of the body 12 may include bumps, ridges, ribs, and/or other surface features. For example, as depicted in FIGS. 1-4, the clamp may include the compression ribs 80 and 80*a-c* (which also may be referred to herein as "sleeve-engaging projections 80,") that may extend radially inwards (towards and/or into the lumen 13) from the first side 14 of the body 12 to a tip 82 (which also may referred to herein as "tip portion 82," "end portion 82," and/or "distal end 82"). In some examples, the compression ribs 80 may extend approximately 0.05 inches into the lumen 13 from the first side 14 of the body 12. However, in other examples, the sleeve-engaging projection 80 may extend farther or less far into the lumen 13 from the first side 14 of the body 12. For example, the sleeve-engaging projection 80 may extend at least 0.02 inches and at most 0.25 inches into the lumen 13 from the first side 14 of the body 12.

When included in the clamp 10, the compression ribs 80 may be configured to directly abut, touch, and/or otherwise interface with the tendon assembly 100 (e.g., sleeve 110) to provide a compressive force to the sheathing 120 that is sufficient to prevent the sheathing 120 from moving relative to the tendon 140 prior to tendon tensioning and/or concrete setting (i.e., solidification). In some examples, such as the example depicted in FIG. 1, the compression ribs 80 extend widthwise along the body 12 of the clamp 10 (i.e., orthogonally relative to the third and fourth sides 18 and 20 of the body 12). However, in other examples, the compression ribs 80 may extend along the body 12 at an angle relative to the third and fourth sides 18 and 20. In some examples, such as the example depicted in FIG. 1, the compression ribs 80 such span the width of the body 12 (i.e., extend to the third and fourth sides 18 and 20). However, in other examples, the compression ribs 80 do not extend all the way to both the third and fourth sides 18 and 20 and instead only span a portion of the width of the body 12.

The compression ribs 80 and 80*a-c* may have various shapes, geometries, and/or sizes as depicted in the examples of FIGS. 1-4. For example, the compression ribs 80 may be shaped as partial (e.g., half) cylinders (FIGS. 1 and 4, 80 and 80*c*) that have partial circular (e.g., semi-circular) cross-sections when viewed along a cutting plane parallel to cutting plane A-A. As another example, the compression ribs 80*a* may be shaped as triangular prism (FIG. 2) and may have triangular cross-section when viewed on a cutting plane parallel to cutting plane A-A. In yet another example, the compression ribs 80 may be shaped as partial spheres (e.g., they may be hemispherical). In yet further examples, the compression ribs 80 may comprise other suitable geometric shapes (see FIG. 3).

As introduced above, the compression ribs 80 may be shaped and/or sized to match the geometry of the tendon assembly 100 (e.g., the sleeve 110 of the tendon assembly 100) in some examples. For example, the compression ribs 80 may include indentations 84 at the tips 82 that may conform to the shape and/or geometry of the sleeve 110 of the tendon assembly 100. As one such example (FIG. 3), the indentations 84 may be shaped as an arc of a circle that is approximately the size as the cross-section of the sleeve 110 in examples where the sleeve 110 is cylindrical, so that the indentations 84 match the external geometry of the sleeve 110. In some examples, the tips 82 may additionally or alternatively be shaped to be sharp such as in an embodiment of the tips 82*a* or not be sharp so as to minimize and/or prevent the tips 82 and 82*b* from puncturing the sleeve 110 and/or other components of the tendon assembly 100. For example, the tips 82 may be rounded, curved, smooth, flat, etc. As one such example, the tips 82 may be convex (FIGS. 1 and 4). As another such example, the tips 82*b* may be concave (FIG. 3).

In some examples, the compression ribs 80 may be spaced apart from another from one, around the first side 14 of the body 12, thereby forming pockets 86 (which also may be referred to herein as "cavities 86") between the compression ribs 80. That is, the pockets 86 may separate the compression ribs 80 from one another on the first side 14 of the body 12. In some such examples, the compression ribs 80 may be circumferentially spaced from one another as shown in FIGS. 1-4. In some examples, the compression ribs 80 may be evenly spaced around the first side 14 of the body 12. However, in other examples, the compression ribs 80 may be unevenly distributed around the first side 14 of the body 12. In some examples, such as the example depicted in FIG. 1, the clamp 10 may include ten compression ribs 80. However, in other examples, the clamp 10 may include more or less than ten compression ribs 80 such as six compression ribs 80, eight compression ribs 80, twelve compression ribs 80, fourteen compression ribs 80, twenty compression ribs 80, etc. More generally, clamp 10 may include at least four and at most thirty compression ribs 80.

As a user tightens the clamp 10 around the sheathing 120, the tips 82 of the compression ribs 80 may be the first part of the clamp 10 to touch, compress, and/or otherwise engage the tendon assembly 100 (e.g., sleeve 110). However, as the user continues to tighten the clamp 10, the sleeve 110 may deform, bunch, and otherwise move into the pockets 86 that exist between the ribs 80*a-b* under the increased compressive force provided by the tips 82*a-b* of the compression ribs 80*a-b*, such as is shown in FIGS. 2-3. Thus, the pockets 86 may be configured to allow the sleeve 110 and/or other components of the tendon assembly 100 (e.g., sheathing 120) to deform as the clamp 10 is tightened, thereby dissipating some of the clamping force and further minimizing the risk of puncturing the sheathing 120.

In some examples, the body 12 may be integrally formed with one or more of the fastening mechanisms 60, the compression ribs 80, the closure tabs 90, and/or the hinge 40. In examples where the body 12 comprises a two-piece configuration (FIGS. 1-4) the first and second pieces 22 and 28 of the body 12 may be formed separately, but may each be integrally formed as a single unitary structure with one or more of the fastening mechanism 60, the compression ribs 80, the closure tabs 90, and/or the hinge 40. In examples where the body 12 comprises a single piece, the entire body 12 may be integrally formed as a single unitary structure with one or more of the fastening mechanisms 60, the compression ribs 80, the closure tabs 90, and/or the hinge 40. The body 12 and/or the pieces 22 and 28 of the body 12 may be integrally formed via injection molding, die casting, laser cutting, or other suitable manufacturing process. Because the body 12 can be manufactured as a single piece, or just two pieces, the clamp 10 may be cheaper and easier to manufacture than conventional techniques for securing the sheathing 120 relative to the tendon 140. Even in the two-piece configuration shown in FIGS. 1-4, the two pieces 22 and 28 may be identical, and thus may be formed from the same mold and/or using the same process. This repeatability may further reduce the cost of manufacturing the clamp 10. Further because the pieces of the body 12 may be identical, the clamp 10 has a modular design that can easily be broken down into more than two pieces. For example, the clamp 10 can be manufactured as three, four, five, or more identical pieces that are then coupled together at the time of clamping).

However, in other examples, one or more of the fastening mechanisms 60, the compression ribs 80, the closure tabs 90, and/or the hinge 40 may be formed separately from the body 12 and may be permanently coupled to the body 12 via adhesives, welding, fasteners, and/or other suitable permanent coupling means.

The clamp 10 may be constructed from various materials. For example, the clamp 10 can comprise one or more polymers (e.g., polyvinyl chloride (PVC), high density polyethylene (HDPE), nylon, rubber), a metal or metal alloy, and/or a composite.

Referring now to FIGS. 2-6, the tendon assembly 100*a-f* comprises the sleeve 110, the sheathing 120, a lubricative coating 130, and the tendon 140. The tendon 140 may be coated and/or otherwise covered in the lubricative coating 130 and at least a portion of the tendon 140 may be encased in the sheathing 120. That is, on the portions of the tendon 140 where the sheathing 120 is included, the sheathing 120 may fully circumferentially surround the tendon 140 such that the tendon 140 is concentrically positioned within the sheathing 120. In some examples, the sheathing 120 may be extruded onto or otherwise wrapped around the tendon 140. In some such examples, the coating 130 may be applied directly to the tendon 140 and then the sheathing 120 may be extruded onto the tendon 140 thereafter. In other examples, the coating 130 may be injected into the sheathing 120 after the sheathing 120 has been extruded on the sheathing 120, in the space between the sheathing 120 and the tendon 140. The coating 130 is thus included between the sheathing 120 and the tendon 140 and is configured to permit the tendon 140 to move (e.g., slide axially) relative to the sheathing 120, such as during tensioning.

In some examples, the lubricative coating 130 may comprise a grease. The sheathing 120 may be constructed from a high-density polyethylene, nylon, and/or other synthetic polymer. The tendon 140 may comprise a metal cable and may be constructed from a suitable metal and/or metal alloy such as steel.

At least a portion of the sheathing 120 may be encased in the sleeve 110. That is, on the portions of the sheathing 120 where the sleeve 110 is included, the sleeve 110 may fully circumferentially surround the sheathing 120 such that the sheathing 120 is concentrically positioned within the sleeve 110. In some examples, the sleeve 110 may be fitted over the sheathing 120 and then attached to an anchor 202 (FIGS. 6-7). However, in other examples, the sleeve 110 may be coupled to the anchor beforehand (and/or may come pre-assembled with the anchor 202), and the rest of the tendon assembly 100 (the sheathing 120, tendon 140, and coating 130) may be inserted through the sleeve 110 and/or anchor 202. The sleeve 110 may be constructed from a urethane, polyurethane, or other type of plastic and/or synthetic polymer.

In some examples, such as the examples depicted in FIGS. 2-7, the sheathing 120, tendon 140, and/or the sleeve 110 may be cylindrical, and may have a circular cross-section. In such some examples (where the tendon 140, sheathing 120, and sleeve 110 are cylindrical), the tendon 140 may be approximately 0.5 inches in diameter, the sheathing 120 may have an outer diameter of approximately 0.65 inches, and the sleeve may have an outer diameter of approximately 0.8 inches. However, in other examples, the tendon 140, sheathing 120, and/or sleeve 110 may have other diameters/sizes. For example, the tendon 140 may have a diameter of at least 0.25 inches and at most 1 inch. The sheathing 120 may have an outer diameter of at least 0.4 inches and at most 1.5 inches, and the sleeve 110 may have an outer diameter of at least 0.5 inches and at most 3 inches. In still further examples, the tendon 140, sheathing 120, and/or sleeve 110 may not be cylindrical and may comprise alternative geometries not having a circular cross-section. Further, although the tendon 140 is depicted as comprising multiple (seven) strands in FIG. 5, it should be appreciated that in other examples, the tendon 140 may comprise more or less than seven strands (e.g., one strand, two strands, three strands, four strands, five strands, six strands, eight strands, nine strands, and/or ten strands).

As introduced above, the clamp 10 and tendon assembly 100 may be included a post-tensioning assembly 200 to strengthen concrete 250 (FIGS. 6-7). Referring to FIGS. 6-7, the post-tensioning assembly 200 (which also may be referred to as "unbonded post-tensioning assembly 200") may be assembled within forms 220 of the concrete 250 and may comprise the tendon assembly 100, the clamp 10, and anchors 202 (which also may be referred to herein as "anchorage assemblies 202").

The anchors 202 may include plates 204 (FIG. 7) that are configured to transfer the compressive force of the tendon 140, when it is tensioned, to the concrete 250. The anchors 202 further may include channels 206 (FIG. 7) into which the tendon 140 and/or sleeve 110 may extend. As shown in FIG. 6, at least one end of the tendon 140 may extend all of the way through the channel 206 of one of the anchors 202 and extend out the other side of the anchor 202 so that it can be pulled by a tensioning mechanism 230 (e.g., hydraulic jack). This end of the tendon (the end of the tendon 140 that is configured to be pulled, stretched, and/or otherwise tensioned by the tensioning mechanism 230) may be referred to as live end 142 of the tendon 140. Accordingly, the end portion of the post-tensioning assembly 200 that includes this live end 142 of the tendon 140 may be referred to as live end portion 208. Opposite the live end 142, the tendon 140 may include a dead end 144 that is configured to be permanently secured (e.g., fixed) to the other anchor 202. This opposite end portion of the post-tensioning assembly 200 (the end that includes the dead end 144 of the tendon 140 may be referred to herein as dead end portion 210. In some examples, one or more of the tendon 140, the sheathing 120, and/or the sleeve 110 are permanently coupled to the anchor 202 at the dead end portion 210 of the post-tensioning assembly 200. In some such examples, one or more of the tendon 140, the sheathing 120, and/or the sleeve 110 may be pre-assembled with the anchor 202 at the dead end portion 210 of the post-tensioning assembly 200, and thus may not need to be coupled together and/or otherwise assembled at the construction site.

The sheathing 120 may extend over the portion of the tendon 140 included between the anchors 202, but may stop short of at least one of the anchors 202, in some examples. As one such example, the sheathing 120 may be fixed and/or coupled to the anchor 202 at the dead end portion 210 of the post-tensioning assembly 200, but may not extend all the way to the other anchor 202 at the live end portion 208 of the post-tensioning assembly 200 (FIG. 7), or vice versa. In another such example where the post-tensioning assembly 200 includes the two sleeves 110 at the opposite end portions of the post-tensioning assembly (FIG. 6), the sheathing 120 may extend between, to, into, and/or through both of the sleeves 110 (and, for example, past both of the clamps 10), but may stop short of both of the anchors 202 (i.e., the sheathing 120 may not be coupled to either one of the anchors 202).

In some such examples where the sheathing 120 does not extend all of the way to one or more of the anchors 202, the sheathing 120 may be manufactured this way, or cut to length at the construction site. Specifically, the sheathing 120 may be manufactured such that it does not cover the tendon 140 near one or more of the ends 142 and/or 144 of the tendon 140 and/or so that it does not reach one or more of the anchors 202. In other such examples, the sheathing 120 may be removed from the tendon 140 at or near one or more of the ends 142 and/or 144 of the tendon 140. The sheathing 120 may not be included and/or may be removed at the live end 142 of the tendon 140 to allow the tensioning mechanism 230 to pull only the tendon 140 (not the tendon 140 and the sheathing 120).

However, even in such examples where the sheathing 120 stops short of one or more of the anchors 202, the sheathing 120 still extends into the sleeve 110 and/or past the clamp 10 to ensure that no portion of the tendon 140 is directly exposed to the concrete 250. Thus, as shown in FIGS. 6 and 7, the sleeve 110 at the live end portion 208 and the dead end portion 210 of the post-tensioning assembly 200 covers and circumferentially surrounds the sheathing 120. In some examples, the sheathing 120 also extends past the clamps 10 so that the clamps 10 can actually hold the sheathing 120 in place relative to the tendon 140.

In other examples, the sheathing 120 fully extends between both anchors 202 and completely covers the tendon 140 between the anchors 202.

The sleeve 110 is included one or more of the live end portion 208 and/or the dead end portion 210. In some examples, such as is depicted in FIGS. 6-7 the post-tensioning assembly 200 may include two sleeves 110, one at the live end portion 208 and one at the dead end portion 210. However, in other examples, the post-tensioning assembly 200 may include only one sleeve 110 at either the live end portion 208 or the dead end portion 210. In some examples, such as is depicted in FIGS. 6-7, the sleeve 110 only extends along a portion of the tendon assembly 100 and does not extend all of the way between the anchors 202. For example, the sleeve 110 may extend at least three inches and at most three feet along the tendon assembly 100. However, in other examples, the sleeve 110 may fully extend between the anchors 202.

In some examples, the sleeve 110 may couple to one or more of the anchors 202. In some such examples, the anchor 202 may include a sleeve lock 212 that is configured to couple, secure, and/or otherwise hold the sleeve 110 in place relative to the anchor 202.

Thus, the sleeve 110 and sheathing 120 may cover the entire portion of the tendon 140 that is included within the concrete 250. Specifically, the sleeve 110 and sheathing 120 may overlap with one another to ensure that no portion of the tendon 140 is directly exposed to the concrete 250. In this way, the portion of the tendon 140 that is included in the concrete 250 (i.e., between the forms 220) may remain fully covered, sealed, and/or otherwise protected from the concrete 250 by the sheathing 120 and/or the sleeve 110 so that no portion of the tendon 140 comes directly into contact with the concrete 250. As explained above, this ensures that the tendon 140 does not directly bond to the concrete 250 so that the tendon 140 can: 1) be tensioned; and/or 2) tensioned with the least amount of force possible.

The anchors 202 may be removably coupled to and/or at least partially embedded within the forms 220, such that the anchors 202 are initially held in place by the forms 220. However, the anchors 202 may permanently bond to the concrete 250 when the concrete 250 is poured, and the forms 220 may be subsequently detached from the anchors 202, with the anchors 202 remaining permanently coupled to the concrete 250. The forms 220 may be constructed from wood or other material that does not bond to the concrete 250. Thus, the forms are configured to provide the concrete 250 with its shape but are configured to be removed from the concrete 250 after the concrete 250 has set/solidified.

The clamp 10 may positioned at a place along the tendon assembly 100 where the sleeve 110, sheathing 120, and tendon 140 all exist (where the tendon 140 is positioned concentrically within the sheathing 120 and where the sheathing 120 is in turn positioned concentrically within the sleeve 110). Thus, the clamp may fit over the entire tendon assembly 100 (i.e., the sleeve 110, sheathing 120, coating 130, and tendon 140). In this way, the clamp 10 may directly contact and/or otherwise interface with the sleeve 110. In some examples, the clamp 10 may be positioned on the tendon assembly 100 such that it is spaced away (i.e., inwards) from the anchors 202. That is the clamp 10 may not abut and/or directly touch the anchors 202. However, in other examples, the clamp 10 may be positioned adjacent to the anchors 202. Regardless of the positioning along the sheathing 120, the clamp 10 may not be coupled to the anchors 202 themselves.

As explained above, the compression ribs 80 of the clamp 10 may initially contact and/or compress the sleeve 110. As the compression ribs 80 compress the sleeve 110, the sleeve 110 may bunch up in the pockets 86 formed between the compression ribs 80. Compression of the sleeve 110 also may compress the sheathing 120, squeezing it against the tendon 140. In this way, the clamp 10 may hold the sheathing 120 in place relative to the tendon 140.

In some examples, the post-tensioning assembly 200 may include only one clamp 10 at either the live end portion 208 or the dead end portion 210. However, in other examples, the post-tensioning assembly 200 may include two clamps 10 at both ends of the post-tensioning assembly 200 (one clamp 10 at the live end portion 208 and another clamp 10 at the dead end portion 210).

In operation, the post-tensioning assembly 200 (including the clamp 10, and the tendon assembly 100) may be assembled with the forms 220 prior to pouring of the concrete 250. Specifically the tendon assembly 100 may be assembled with the anchors 202 such that the tendon 140 is permanently secured to the one of the anchors 202 at the dead end portion 210 and extends entirely through the channel of the anchor 202 to the other side of the anchor 202 so that is can be easily accessed for tensioning. A user may clamp the tendon assembly 100 at one or more of the live end portion 208 and/or the dead end portion 210 of the post-tensioning assembly 200 to ensure that the sheathing 120 does not move relative to the tendon 140.

The concrete 250 may then be poured into the forms 220, over the tendon assembly 100, clamp 10, and/or the anchors 202. After the concrete has set, the forms 220 may be removed from the concrete 250 and the tendon 140 may be stretched/tensioned with the tensioning mechanism 230. Once the tendon 140 is stretched to a desired tension level, the tendon 140 may be secured in this stretched/tensioned state by a locking mechanism 240 (e.g., wedge). Specifically, the locking mechanism 240 may couple the live end 142 of the tendon 140 to the anchor 202, thereby preventing the tendon 140 from moving relative to the anchor 202. Because the anchor 202 is held in place by the solidified concrete 250, the anchor 202 may prevent the tendon 140 from retracting back towards a relaxed state. In this way, the anchors 202 transfers the compressive force of the stretched/tensioned tendon to the concrete 250. Because the tendon assembly 100 includes the lubricative coating 130, the tautness of the tendon 140 may be adjusted at later points in time as desired by, for example, releasing the locking mechanism 240 and either relaxing the tendon 140 or further stretching the tendon 140, and then re-engaging the locking mechanism 240.

In some examples, one or more of the end portions 208 and/or 210 of the post-tensioning assembly 200 may include a grease cap 244 that is configured to trap and/or otherwise retain the lubricative coating 130 within the post-tensioning assembly 200 (e.g., within the sheathing 120). As one example, the grease cap 244 may be included on the outside of and/or within the anchors 202 and may provide a seal between the anchors 202 and the sheathing 120 to prevent leakage of the lubricative coating 130 from the sheathing 120.

Additional Examples of the Disclosed Technology

Additional examples of the disclosed technology are enumerated below.

1. A sheathing-retaining clamp for a post-tensioning assembly, the sheathing-retaining clamp comprising:
   - a body comprising a concave first side opposite a second side and a third side opposite a fourth side, wherein the body is adjustable between an open position and a closed position, and wherein in the closed position, the body defines a lumen that extends from the third side to the fourth side and that is configured to receive a tendon assembly of the post-tensioning assembly, and wherein the body is configured to wrap around the tendon assembly in the closed position with the concave first side facing the tendon assembly;
   - a fastening mechanism configured to lock the body in the closed position; and
   - a plurality of sleeve-engaging projections extending from the concave first side of the body that are configured to directly contact and compress the tendon assembly when the body is in the closed position.

2. The clamp of any example herein, wherein the plurality of sleeve-engaging projections extend between the third and fourth sides of the body.

3. The clamp of any example herein, wherein the plurality of sleeve-engaging projections are half cylinders.

4. The clamp of any example herein, wherein the plurality of sleeve-engaging projections are triangular prisms.

5. The clamp of any example herein, wherein the plurality of sleeve-engaging projections are rectangular prisms.

6. The clamp of any example herein, wherein the plurality of sleeve-engaging projections are partial spheres.

7. The clamp of any example herein, wherein the plurality of sleeve-engaging projections are hemispherical.

8. The clamp of any example herein, wherein the plurality of sleeve-engaging projections are partial ellipsoids.

9. The clamp of any example herein, wherein the plurality of sleeve-engaging projections comprise at least six projections.

10. The clamp of any example herein, wherein each of the plurality of sleeve-engaging projections comprise a concave indentation at a distal end/distal end portion/tip/tip portion of each of the plurality of sleeve-engaging projections that is configured to conform to a geometry of the tendon assembly.

11. The clamp of any example herein, wherein a cross-section of the concave indentation is an arc of a circle.

12. The clamp of any example herein, wherein the plurality of sleeve-engaging projections extend at least 0.05 inches from the concave first side of the body.

13. The clamp of any example herein, wherein the fastening mechanism is adjustable and is configured to lock the body at more than one position to provide varying compressive forces to the tendon assembly.

14. The clamp of any example herein, wherein the fastening mechanism comprises a ratchet.

15. The clamp of any example herein, wherein the fastening mechanism comprises a plurality mating and interfacing teeth.

16. The clamp of any example herein, wherein the fastening mechanism comprises interlocking hooks.

17. The clamp of any example herein, wherein the fastening mechanism comprises a tooth and a groove.

18. The clamp of any example herein, wherein the fastening mechanism comprises interlocking flanges.

19. The clamp of any example herein, wherein the body comprises a single, unitary piece that is sufficiently flexible to open and wrap around the tendon assembly, and wherein the fastening mechanism is included at opposing end portions of the body and is configured to removably couple the opposing end portions of the body to selectively lock the body in the closed position.

20. The clamp of any example herein, wherein the fastening mechanism is integrally formed with the body.

21. The clamp of any example herein, wherein the body comprises two distinct pieces.

22. The clamp of any example herein, further comprising a hinge that permanently couples the two distinct pieces of the body to one another at respective first ends of the two distinct pieces, and wherein the two distinct pieces are removably coupled to one another at respective second ends by the fastening mechanism.

23. The clamp of any example herein, wherein the clamp includes the fastening mechanism at respective first ends of the two distinct pieces of the body and further comprises another fastening mechanism at respective second ends of the two distinct pieces such that the two distinct pieces are removably coupled to one another via the two fastening mechanisms.

24. The clamp of any example herein, wherein the fastening mechanism comprises a female component and a male component that are configured to be included on adjacent ends of the body.

25. The clamp of any example herein, wherein the female component comprises a hook with a groove and the male component comprises a tooth that is configured to lock in the groove of the hook to hold the body in the closed position.

26. The clamp of any example herein, wherein a first end portion of a first piece of the two distinct pieces comprises the female component and an opposite second end portion of the first piece comprises the male component, and wherein a first end portion of a second piece of the two distinct pieces comprises the male component and an opposite second end portion of the second piece comprises the female component.

27. The clamp of any example herein, wherein the fastening mechanism is adjustable between an engaged state and a disengaged stated, wherein in the engaged state, the fastening locks the body in the closed position, and wherein in the disengaged state, the fastening mechanism releases the body from the closed position and allows the body to move to the open position.

28. The clamp of any example herein, further comprising closure tabs that extend radially outward from the body and that are configured to engage with a clamping tool to move the fastening mechanism to the engaged state.

29. The clamp of any example herein, wherein the clamp is constructed from polyvinyl chloride.

30. The clamp of any example herein, wherein, the fastening mechanism comprises ramped surfaces that are configured to facilitate movement of the body to the closed position.

31. The clamp of any example herein, wherein the plurality of sleeve-engaging projections are spaced from one another on the first side of the body, forming pockets between the plurality of sleeve-engaging projections that are configured to permit the tendon assembly to deform under a compressive load applied by the plurality of sleeve-engaging projections.

32. A concrete post-tensioning assembly comprising:

an anchor;

a tendon assembly, comprising:

a tendon that extends through the anchor; and a sheathing covering the tendon; and a sheathing clamp that is configured to prevent movement of the sheathing relative to the tendon, the sheathing clamp comprising:

a body adjustable between an open position and a closed position, wherein in the closed position, the body is configured to wrap around the tendon assembly of the post-tensioning assembly;

a fastening mechanism configured to lock the body in the closed position; and a plurality of sleeve-engaging projections that extend radially inwards from the body in the closed position and that are configured to directly contact the tendon assembly.

33. The concrete post-tensioning assembly of any example herein, wherein the sheathing clamp of the concrete post-tensioning assembly comprises the clamp of any example herein.

34. The concrete post-tensioning assembly of any example herein, wherein the sheathing clamp is coupled to the tendon assembly at a dead-end portion of the post-tensioning assembly.

35. The concrete post-tensioning assembly of any example herein, wherein the sheathing clamp is coupled to the tendon assembly at a live end portion of the post-tensioning assembly.

36. The concrete post-tensioning assembly of any example herein, wherein the sheathing clamp is not coupled to the anchor.

37. The concrete post-tensioning assembly of any example herein, wherein the concrete post-tensioning assembly comprises an unbonded post tensioning assembly wherein the tendon is configured to be repeatedly re-tensioned.

38. The concrete post-tensioning assembly of any example herein, further comprising a lubricative coating that is included between the tendon and the sheathing to facilitate movement of the tendon relative to the sheathing during tensioning of the tendon.

39. The concrete post-tensioning assembly of any example herein, wherein the tendon assembly further comprises a sleeve that covers at least a portion of the sheathing.

40. The concrete post-tensioning assembly of any example herein, wherein the sheathing clamp wraps around and directly contacts the sleeve of the tendon assembly.

41. A clamp for a post-tensioning assembly configured to prevent movement of a sheathing of the post-tensioning assembly relative to a tendon of the post-tensioning assembly, the clamp comprising:

a body adjustable between an open position and a closed position, wherein in the closed position, the body is configured to wrap around a tendon assembly of the post-tensioning assembly;

a fastening mechanism configured to lock the body in the closed position; and a plurality of sleeve-engaging projections that extend radially inwards from the body in the closed position and that are configured to directly contact a sleeve of the tendon assembly.

42. A sheathing-retaining clamp for a post-tensioning assembly, the sheathing-retaining clamp comprising:

a body comprising a channel that is configured to receive a tendon assembly of the post-tensioning assembly, the body adjustable between an open position and a closed position;

a fastening mechanism configured to lock the body in the closed position;

and a plurality of sleeve-engaging projections extending radially inwards from the body into the cylindrical channel that are configured to directly contact a sleeve of the tendon assembly.

43. A method comprising:

clamping a tendon assembly of a concrete post-tensioning assembly with a clamp that is spaced away from an anchor of the post-tensioning assembly to prevent movement of a sheathing of the tendon assembly relative to a tendon of the tendon assembly.

44. The method of any example herein, wherein the concrete post-tensioning assembly comprises the concrete post-tensioning assembly of any example herein, and wherein the clamp comprises the clamp of any example herein.

Any feature(s) of any example(s) disclosed herein can be combined with or isolated from any feature(s) of any example(s) disclosed herein, unless otherwise stated.

In view of the many possible embodiments to which the principles of the disclosure may be applied, it should be recognized that the illustrated embodiments are only examples and should not be taken as limiting the scope of the disclosure.

The invention claimed is:

1. A concrete post-tensioning assembly comprising:
an anchor;
a tendon assembly comprising:
a tendon; and
a sheathing covering the tendon; and
a sheathing-retaining clamp configured to apply a compressive force to the tendon assembly to squeeze the sheathing against the tendon and to prevent movement of the sheathing relative to the tendon, the sheathing-retaining clamp comprising:
a unitary body of one-piece construction adjustable between an open position and a closed position, wherein in the closed position, the body is configured to wrap completely around the tendon assembly; and
a fastening mechanism configured to lock the body in the closed position.

2. The concrete post-tensioning assembly of claim 1, wherein the sheathing clamp is not coupled to the anchor.

3. The concrete post-tensioning assembly of claim 1, wherein the sheathing clamp is spaced away from the anchor by a portion of the tendon assembly.

4. The concrete post-tensioning assembly of claim 1, wherein the sheathing clamp is coupled to the tendon assembly at a live end or dead end portion of the post-tensioning assembly.

5. The concrete post-tensioning assembly of claim 1, wherein the concrete post-tensioning assembly comprises an unbonded post tensioning assembly wherein the tendon is configured to be repeatedly re-tensioned.

6. The concrete post-tensioning assembly of claim 1, further comprising a lubricative coating included between the tendon and the sheathing to facilitate movement of the tendon relative to the sheathing during tensioning of the tendon.

7. The concrete post-tensioning assembly of claim 1, wherein the body of the sheathing-retaining clamp is sufficiently flexible to open and wrap around the tendon assembly, and wherein the fastening mechanism is included at opposing end portions of the body and is configured to removably couple the opposing end portions of the body to selectively lock the body in the closed position.

8. The concrete post-tensioning assembly of claim 1, wherein the tendon assembly comprises a sleeve that covers at least a portion of the sheathing covering the tendon.

9. The concrete post-tensioning assembly of claim 8, wherein the sheathing-retaining clamp wraps around in a circumscribing manner and directly contacts the sleeve of the tendon assembly.

10. The concrete post-tensioning assembly of claim 8, wherein the sleeve extends at least partially through a channel of the anchor.

11. The concrete post-tensioning assembly of claim 1, wherein the sheathing-retaining clamp comprises a plurality of compression ribs that extend radially inwards from an inner side of the body and that are configured to directly contact the tendon assembly when the body is in the closed position.

12. The concrete post-tensioning assembly of claim 11, wherein the plurality of compression ribs are shaped as partial cylinders.

13. The concrete post-tensioning assembly of claim 11, wherein the plurality of compression ribs are spaced apart from one another, forming pockets therebetween that are configured to receive the tendon assembly to allow the tendon assembly to bunch up in the pockets as the sheathing-retaining clamp is tightened around the tendon assembly.

14. A concrete post-tensioning assembly comprising:
an anchor;
a tendon assembly comprising:
a tendon; and
a sheathing covering the tendon; and
a sheathing-retaining clamp configured to apply a compressive force to the tendon assembly to squeeze the sheathing against the tendon and to prevent movement of the sheathing relative to the tendon, the sheathing-retaining clamp comprising:
a body comprising two distinct pieces adjustable between an open position and a closed position, wherein in the closed position, the body is configured to wrap completely around the tendon assembly; and
a fastening mechanism configured to lock the body in the closed position.

15. The concrete post-tensioning assembly of claim 14, wherein the sheathing clamp is not coupled to the anchor.

16. The concrete post-tensioning assembly of claim 14, wherein the sheathing clamp is spaced away from the anchor by a portion of the tendon assembly.

17. The concrete post-tensioning assembly of claim 14, wherein the sheathing clamp is coupled to the tendon assembly at a live end or dead end portion of the post-tensioning assembly.

18. The concrete post-tensioning assembly of claim 14, wherein the concrete post-tensioning assembly comprises an unbonded post tensioning assembly wherein the tendon is configured to be repeatedly re-tensioned.

19. The concrete post-tensioning assembly of claim 14, further comprising a lubricative coating included between the tendon and the sheathing to facilitate movement of the tendon relative to the sheathing during tensioning of the tendon.

20. The concrete post-tensioning assembly of claim 14, wherein a hinge permanently couples the two distinct pieces of the body to one another at respective first ends of the two distinct pieces, and wherein the two distinct pieces are removably coupled to one another at respective second ends by the fastening mechanism.

21. The concrete post-tensioning assembly of claim 14, wherein the sheathing-retaining clamp includes the fastening mechanism at respective first ends of the two distinct pieces of the body and further comprises another fastening mechanism at respective second ends of the two distinct pieces such that the two distinct pieces are completely detachable from one another by releasing both of the fastening mechanisms.

22. The concrete post-tensioning assembly of claim 14, wherein the tendon assembly comprises a sleeve that covers at least a portion of the sheathing covering the tendon.

23. The concrete post-tensioning assembly of claim 22, wherein the sheathing-retaining clamp wraps around in a circumscribing manner and directly contacts the sleeve of the tendon assembly.

24. The concrete post-tensioning assembly of claim 22, wherein the sleeve extends at least partially through a channel of the anchor.

25. The concrete post-tensioning assembly of claim 14, wherein the sheathing-retaining clamp comprises a plurality of compression ribs that extend radially inwards from an inner side of the body and that are configured to directly contact the tendon assembly when the body is in the closed position.

26. The concrete post-tensioning assembly of claim 25, wherein the plurality of compression ribs are shaped as partial cylinders.

27. The concrete post-tensioning assembly of claim 25, wherein the plurality of compression ribs are spaced apart from one another, forming pockets therebetween that are configured to receive the tendon assembly to allow the tendon assembly to bunch up in the pockets as the sheathing-retaining clamp is tightened around the tendon assembly.

28. The concrete post-tensioning assembly of claim 14, wherein the fastening mechanism comprises a female component and a male component that are configured to releasably couple to one another to lock the body in the closed position.

29. The concrete post-tensioning assembly of claim 28, wherein the female component comprises a hook having a groove, and wherein the male component comprises a tooth, wherein the tooth is configured to be received within the groove of the hook to lock the body in the closed position.

30. The concrete post-tensioning assembly of claim 28, wherein the sheathing-retaining clamp comprises closure tabs that extend radially outward from the body and that are configured to engage with a clamping tool to move the body to the closed position.

* * * * *